US008550852B2

(12) United States Patent
Goossens et al.

(10) Patent No.: US 8,550,852 B2
(45) Date of Patent: Oct. 8, 2013

(54) ELECTRICAL CONNECTOR WITH STAGGERED SINGLE ENDED CONTACTS

(75) Inventors: Thierry Goossens, Herdersem-aalst (BE); Bernardus Paagman, Schijndel (NL); Stefaan Hendrik Jozef Sercu, Brasschaat (BE); Ludwig Lange, Nuland (NL)

(73) Assignee: FCI, Versailles (FR)

( * ) Notice: Subject to any disclaimer, the term of this patent is extended or adjusted under 35 U.S.C. 154(b) by 143 days.

(21) Appl. No.: 12/451,594

(22) PCT Filed: May 23, 2007

(86) PCT No.: PCT/IB2007/052716

§ 371 (c)(1),
(2), (4) Date: Mar. 12, 2010

(87) PCT Pub. No.: WO2008/142489

PCT Pub. Date: Nov. 27, 2008

(65) Prior Publication Data

US 2010/0203765 A1 Aug. 12, 2010

(51) Int. Cl.
*H01R 24/00* (2011.01)

(52) U.S. Cl.
USPC ..... 439/626; 439/941

(58) Field of Classification Search
USPC ..... 439/626, 941, 65, 108, 607.05, 607.07
See application file for complete search history.

(56) References Cited

U.S. PATENT DOCUMENTS

| | | | | |
|---|---|---|---|---|
| 5,879,197 | A * | 3/1999 | Dewey | 439/668 |
| 6,343,955 | B2 * | 2/2002 | Billman et al. | 439/607.48 |
| 6,352,451 | B1 * | 3/2002 | Henneberger et al. | 439/668 |
| 6,641,411 | B1 | 11/2003 | Stoddard et al. | 439/108 |
| 6,808,420 | B2 * | 10/2004 | Whiteman et al. | 439/607.08 |
| 6,843,686 | B2 | 1/2005 | Ohnishi et al. | 439/608 |
| 6,863,549 | B2 | 3/2005 | Brunker et al. | 439/108 |
| 6,969,268 | B2 * | 11/2005 | Brunker et al. | 439/108 |
| 7,207,807 | B2 | 4/2007 | Fogg | 439/65 |
| 7,300,290 | B2 * | 11/2007 | Yamagami et al. | 439/79 |
| 7,874,850 | B2 * | 1/2011 | Yamagami et al. | 439/79 |
| 2003/0220021 | A1 * | 11/2003 | Whiteman et al. | 439/608 |
| 2005/0064744 | A1 * | 3/2005 | Yu | 439/79 |
| 2005/0148219 | A1 * | 7/2005 | Myer et al. | 439/79 |
| 2005/0159040 | A1 * | 7/2005 | Brunker et al. | 439/497 |
| 2005/0191907 | A1 * | 9/2005 | Scherer et al. | 439/608 |
| 2005/0196987 | A1 * | 9/2005 | Shuey et al. | 439/108 |
| 2009/0035964 | A1 * | 2/2009 | Yamamoto et al. | 439/79 |
| 2012/0202380 | A1 * | 8/2012 | Lappoehn | 439/607.09 |

* cited by examiner

*Primary Examiner* — Neil Abrams
*Assistant Examiner* — Travis Chambers
(74) *Attorney, Agent, or Firm* — Harrington & Smith

(57) ABSTRACT

The invention relates to an electrical connector that includes an insulating connector housing containing a plurality of slots arranged in a matrix of rows and columns. A plurality of single ended contacts is received in the slots. In particular, the single ended contacts are arranged in pairs in said slots of said matrix, such that, in a first row, a first pair of said contacts accommodates slots in a first column and a second column of said matrix and, in a second row adjacent to said first row, a second pair of said contacts accommodates slots in said second column and a third column of said matrix, wherein positions corresponding respectively to the first row and the third column, and to the first column and the second row are free of contact.

22 Claims, 5 Drawing Sheets

ELECTRICAL CONNECTOR WITH STAGGERED SINGLE ENDED CONTACTS

FIELD OF THE INVENTION

Generally, the invention relates to the field of electrical connectors.

BACKGROUND OF THE INVENTION

Specialized electrical connectors are used to connect different electrical components in order to allow electrical signal transmission between these components. It is known that cross talk between contacts of such an electrical connector influences the signal integrity of the signals transmitted by these electrical connectors.

Several approaches are known in the art for reducing the amount of cross talk between differential signaling contacts in the electrical connectors and, thus, to improve the signal integrity of these connectors.

In some differential signal connectors, a configuration of shielding plates and ground contacts is used to minimize cross talk between contacts of the connector. However, this approach results in connectors with lots of components and, consequently, expensive and heavy connectors.

In other differential signal connectors, shielding plates have been omitted. In these connectors, pairs of differential signal contacts are arranged in a staggered fashion in slots of a regular matrix and ground contacts are arranged between the staggered pairs of differential signal contacts in order to minimize cross talk between the differential signal contacts.

In still other differential signal connectors, an approach is taken wherein the housing of the electrical connector is modified in order to provide an irregular matrix of staggered slots. The differential signal contacts are received in the staggered slots. The thus achieved staggering of the differential signal contacts reduces the amount of cross talk between these differential signal contacts of the electrical connector.

SUMMARY OF THE INVENTION

It is an object of the invention to provide an electrical connector that is capable of providing a considerable reduction of cross talk between the contacts of the electrical connector.

To that end, an electrical connector is proposed that comprises an insulating connector housing containing a plurality of slots arranged in a matrix of rows and columns. A plurality of single ended contacts is received in the slots. In particular, the single ended contacts are arranged in pairs in said slots of said matrix, such that, in a first row, a first pair of said contacts accommodates slots in a first column and a second column of said matrix and, in a second row adjacent to said first row, a second pair of said contacts accommodates slots in said second column and a third column of said matrix, wherein the positions corresponding respectively to the first row and the third column, and to the first column and the second row are free of contact.

Furthermore, an electrical connector is proposed that comprises an insulating connector housing containing a plurality of slots arranged in a matrix of rows and columns. A plurality of single ended contacts is received in the slots. In particular, the single ended contacts are arranged in row wise pairs in said slots of said matrix, such that, in a first row, a first pair of said contacts accommodates slots in a first column and a second column of said matrix and, in a second row adjacent to said first row, a second pair of said contacts accommodates slots in said second column and a third column of said matrix. The matrix comprises contact-free slots in said rows of said matrix between said pairs of contacts.

Moreover, a tip and ring connector is proposed that comprises an insulating connector housing containing a plurality of slots arranged in a matrix of rows and columns. The insulating housing further accommodates a plurality of modules containing said slots. The connector is free of electromagnetic shielding plates between said modules. A plurality of single ended contacts is arranged in said slots. The single ended contacts are arranged in pairs in said slots of said matrix, such that, in a first row, a first pair of said contacts accommodates slots in a first column and a second column of said matrix and, in a second row adjacent to said first row, a second pair of said contacts accommodates slots in said second column and a third column of said matrix. The matrix comprises contact-free slots in said rows of said matrix between said pairs of contacts.

The prior art electrical connectors that employ staggered signal contacts to obtain an acceptable signal integrity behavior all relate to differential signal electrical connectors. The applicant has realized that the same behavior is sometimes desired for electrical connectors employing single ended contacts, such as connectors for xDSL applications. xDSL applications may involve HDSL, ADSL, VDSL and VDSL2 applications. In conventional electrical connectors with single ended contacts, such as the Metral® electrical connector of the applicant, the single ended signal contacts and ground contacts are located in slots of a housing, which slots arranged in rows and columns of a regular matrix. By removing the ground contacts from the slots of such a conventional connector, the single ended signal carrying contacts are left in the housing in an already staggered configuration as defined in claim 1. Surprisingly, the applicant has found that such a connector has an acceptable signal integrity behavior for xDSL applications, despite the fact that the electrical parameters (voltage, frequency) between single ended contact connectors and differential contact connectors differ considerably. It should be noted that the terms "row(s)" and "column(s)" can be interchanged in the claims.

The embodiment of the invention as defined in claim 2 provides the advantage that the housing of the electrical connector does not require modification.

The embodiments of the invention as defined in claims 5, 6, 9, 10 and 11 provide the advantage of improved manufacturability of the electrical connector.

The embodiment of the invention as defined in claim 8 provides the advantage of providing sufficient space between the board contacts for signal routing tracks while meeting criteria with respect to a minimum clearance and creepage distance.

Further advantageous embodiments are defined in the dependent claims.

It should be noted that the embodiments, or aspects thereof, may be combined.

The invention will be further illustrated with reference to the attached drawings, which schematically show preferred embodiments according to the invention. It will be understood that the invention is not in any way restricted to these embodiments.

DETAILED DESCRIPTION OF THE DRAWINGS

Figure 1:
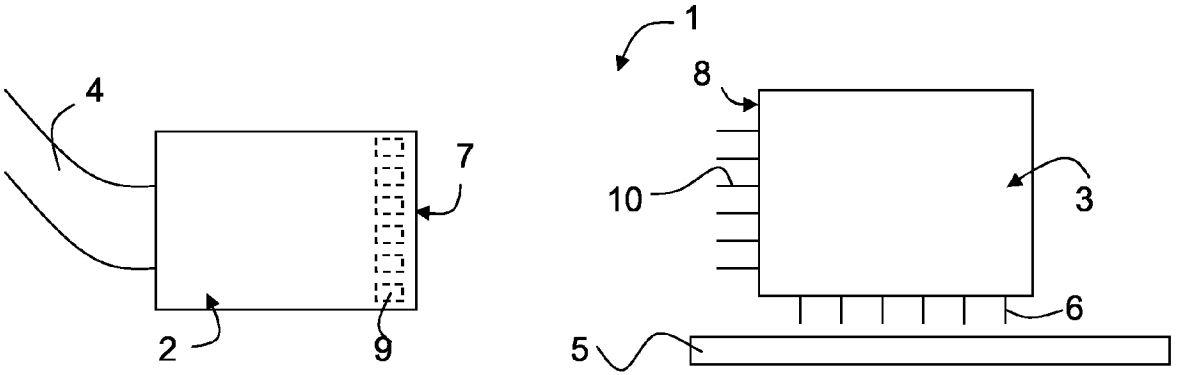
FIG. 1 is a schematic illustration of a connector system according to an embodiment of the invention.

FIG. 1 is a schematic illustration of a connector system 1 comprising a cable connector 2 and a board connector 3. The cable connector 2 receives a cable 4. The board connector 3 is connectable to a printed circuit board (PCB) 5 by terminals 6, e.g. press fit terminals. Typically, the board connector is at least partly provided behind a front panel (not shown). The cable connector 2 and board connector 3 connects at mating sides 7, 8 respectively, wherein the cable connector comprises single ended contacts 9 and the board connector comprises single ended contacts 10. In a mated state of the cable connector 2 and board connector 3, single ended signals can be transferred between wires (not shown) of the cable 4 and the PCB 5. It should be noted that the PCB 5 may be arranged in a vertical orientation. FIG. 1 illustrates schematically that the footprint of the board connector 3, as defined by the arrangement of the terminals 6 to be contacted with the PCB 5 at the board side, is enhanced in comparison with the arrangement of single ended contacts 10 at the mating side 8. In other words, the distance between the terminals 6 at the board side as measured along one or more orthogonal directions is larger that the corresponding distance between the single ended contacts 10, electrically connected to these terminals 6, at the mating side 8 of the board connector 3. As a result, the single ended contacts 10 at the mating side 8 of the board connector 3 can be arranged at distances suitable to match the arrangement of single ended contacts 9 at the mating side 7 of the cable connector 2, whereas requirements set at the board side of the board connector 3 for the minimum clearance and creepage distance can be met while allowing routing of signal tracks on the PCB 5 between the terminals 6.

The values of some electrical parameters for single ended contact applications, such as xDSL applications, differ significantly from those for differential contact applications. As an example, for xDSL applications single ended contacts typically carry voltages of the order of volts (e.g. −48V) as opposed to voltages of the order of millivolts for differential signals, whereas signal frequencies for xDSL applications are of the order of megahertz (e.g. 20 MHz (VDSL) or 30 MHz (VDSL2)) as opposed to frequencies of the order of GHz for differential signals.

FIGS. 2A-2D show schematic illustrations of mating sides of electrical connectors according to embodiments of the invention. In the FIGS., black rectangles indicate slots 11 containing single ended contacts 9, 10, whereas white rectangles indicate (empty) slots 11 free of single ended contacts 9, 10. The slots 11 are arranged in a matrix of rows and columns. It should be appreciated that rows and columns can be interchanged. The contacts 9, 10 are arranged in pairs. As an example, a connector may have 12, 24, 36, 48, 72 or 96 pairs of contacts. Each pair generally has a tip contact and a ring contact as these are typically defined for classical POTS (Plain Old Telephone Service) connectors. "Tip" and "ring" are commonly known terms in the telephone service industry referring to the two sides of an ordinary telephone line used for coupling current signals between a telephone facility and a telephone apparatus connected via tip and ring lead of the telephone line.

Figure 2A:
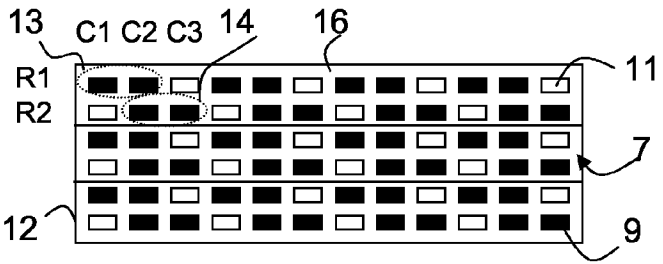
FIGS. 2A-2D show schematic illustrations of mating sides of electrical connectors according to embodiments of the invention.

In particular, FIG. 2A shows a schematic illustration of a cable connector 2, which may be of the product type Metral® of the applicant. The cable connector 2 comprises an insulating connector housing 12 containing a plurality of slots 11 arranged in a regular matrix of rows and columns. The single ended contacts 9 are arranged in row wise pairs in the slots of said matrix, such that, in a first row R1, a first pair 13 of the contacts 9 accommodates slots 11 in a first column C1 and a second column C2 of the matrix and, in a second row R2, adjacent to the first row R1, a second pair 14 of said contacts 9 accommodates slots 11 in the same second column C2 and a third column C3 of the matrix. In other words, the various single ended contact pairs are arranged in a staggered fashion. Otherwise described, the contact arrangement corresponds to an array of units, piled on upon another without staggering. Hence each unit comprises six positions of a matrix having two rows and three columns in which the positions corresponding to the (first row×third column) and to the (second row×first column) are free of contacts.

Figure 4C:
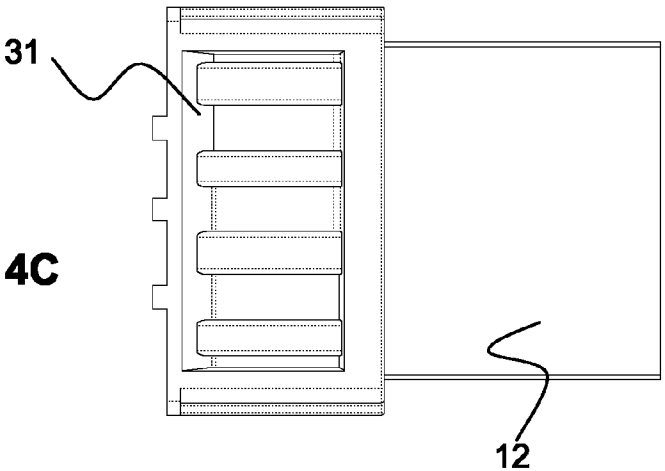
FIGS. 4A-4E illustrate a board connector according to an embodiment of the invention.
Figure 4B:
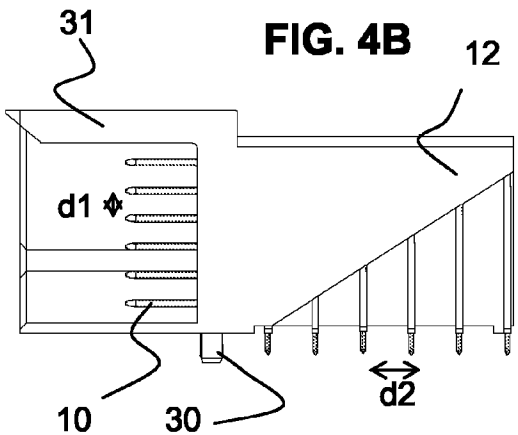
Figure 4A:
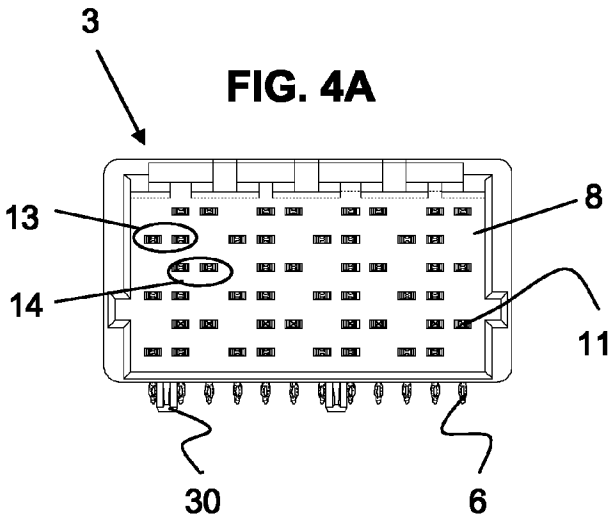

Preferably, the connector is free of signal ground contacts and free of electromagnetic shielding plates. A typical distance between the contacts 9 of pair 13 and pair 14 is 2 mm. It should be appreciated that a board connector 3 to be connected with a cable connector 2 having a staggered arrangements of staggered single ended contacts 9 as illustrated in FIG. 2A comprises a mating side 8 with single ended contacts 10 arranged as a mirror image of the arrangement of FIG. 2A. Such an arrangement is shown in FIG. 4A.

The table below provides measurement results for the near end cross talk (NEXT) and far end cross talk (FEXT) in decibels (dB) at different frequencies (VDSL, VDSL2). The measurements have been performed for a cable connector with four rows R and six columns C for a contact pair in the third row R3. The normal arrangement refers to a cable connector 2, wherein all slots 11 are filled with single ended contacts 9. Clearly, the cross talk results for staggered pairs single ended contacts 9 with empty slots 11 arranged in rows between these pairs show an improved cross talk behavior as compared with a normal arrangement of contacts in the housing. The cross talk performance of the connectors with staggered contacts is suitable for VDSL and VDSL 2 applications.

| | NEXT (20 MHZ) | FEXT (20 MHz) | NEXT (30 MHz) | FEXT (30 MHz) |
|---|---|---|---|---|
| Normal | −45 dB | −55 dB | −40 dB | −52 dB |
| Staggered | −58 dB | −62 dB | −55 dB | −58 dB |

Figure 2B:
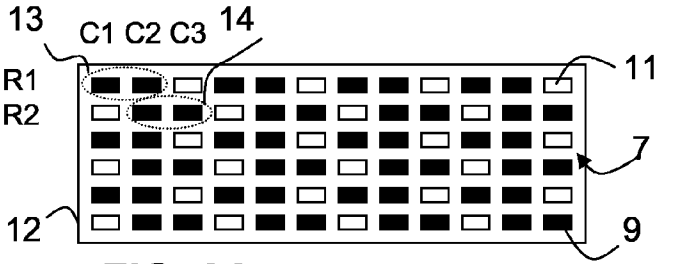
Figure 2C:
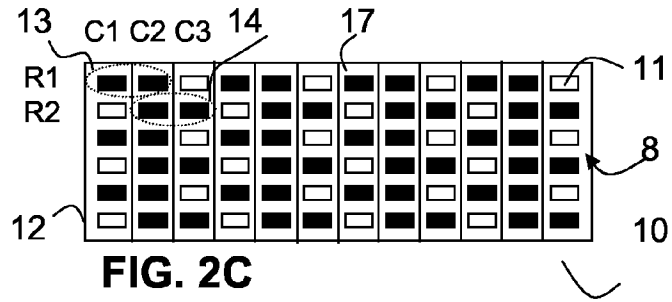

FIGS. 2B-2C show further electrical connectors in accordance with embodiments of the invention. Similar reference signs have been used to indicate identical or similar features of the electrical connector of FIG. 2A.

FIG. 2B is a schematic illustration of a cable connector 2, wherein the slots 11 are provided in three identical modules 16. The slots 11 of each module 16 are preloaded with contacts 9 in a staggered fashion. In FIG. 2B, each module 16 contains two rows R of slots 11.

FIG. 2C is a schematic illustration of a board connector 3, wherein the slots 11 are organized in modules 17 that form columns of slots. As opposed to the modules 16 of the embodiment of FIG. 2B, adjacent modules 17 of the embodiment of FIG. 2C are not identically filled with single ended contacts 10 at the mating side 8.

Figure 2D:
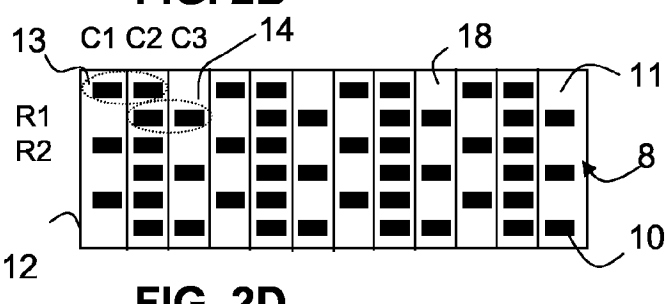

FIG. 2D is a schematic illustration of a board connector 3 in accordance with the invention. As opposed to the embodiment of FIG. 2C, the embodiment of FIG. 2D has modules 18 that only comprise slots 11 at the mating side 8 at positions where single ended contacts 9 are present.

Figure 3C:
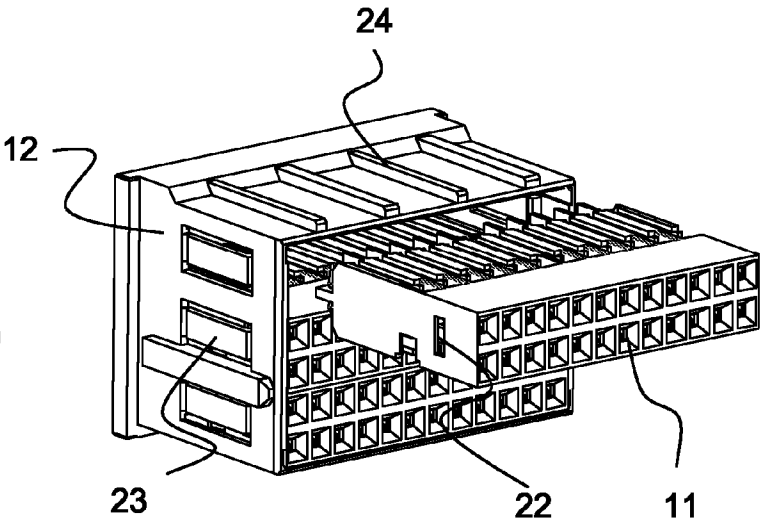
FIGS. 3A-3C illustrate a cable connector according to an embodiment of the invention.
Figure 3A:
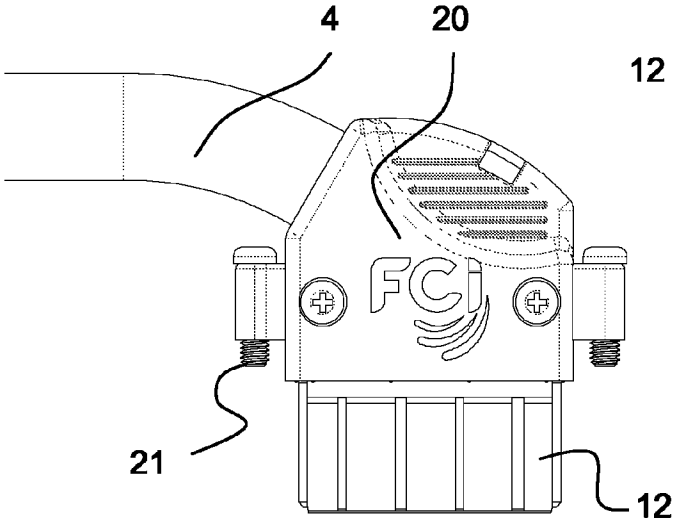
Figure 3B:
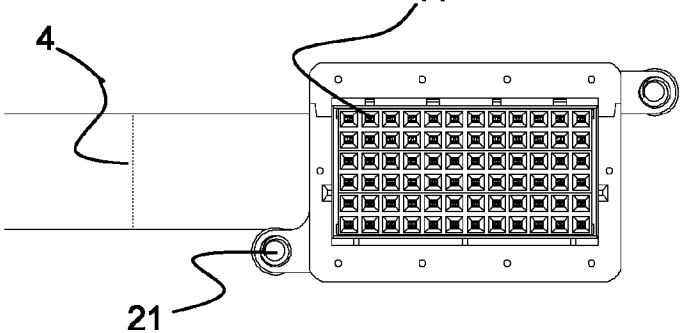

FIGS. 3A-3C illustrate a cable connector 2 according to an embodiment of the invention. The illustrated embodiment corresponds to the schematic illustration of FIG. 2B.

The housing 12 with the modules 16 is partly accommodated in a space defined by a die cast hood 20 and partly extends from this space. In the die cast hood, retention features provide for adequately retaining the cable 4. Wires (not shown) of the cable 4 are connected to the contacts 12 provided in the slots 11. Furthermore, the die cast hood 20 accommodates diametrically arranged fastening means, such as screws 21, for attaching the cable connector 2 to a panel behind which a board connector 3 is present. The hood 20 comprises two parts that are attached by means of screws to allow repair of the connector in the field.

As shown in FIG. 3C, the modules 16 with slots 11 comprise fixation structures 22 arranged for cooperation with fixation structures 23 provided in the insulating housing 12. The housing 12 is provided with guiding bars 24.

Figures 4D, 4E:
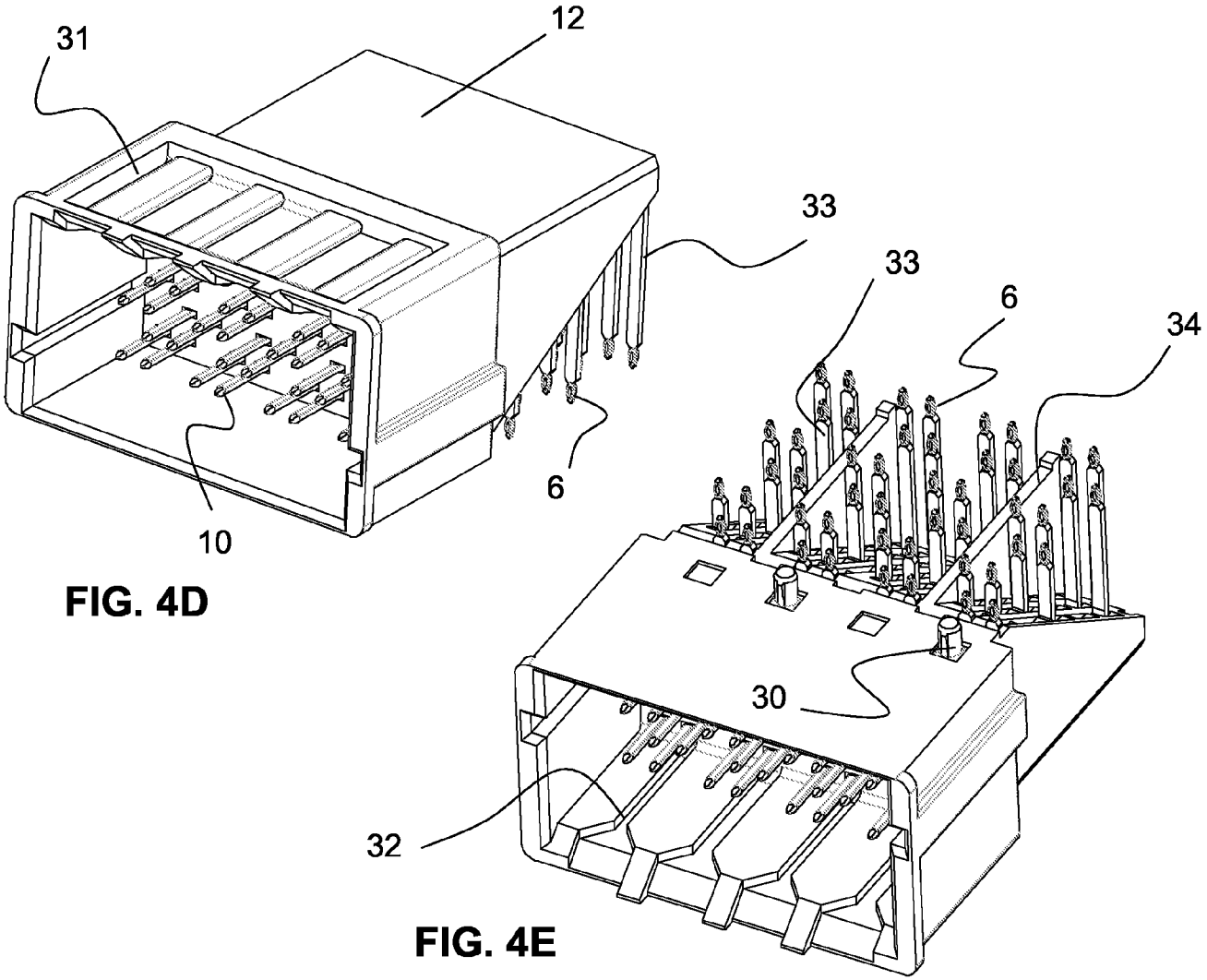

FIGS. 4A-4E illustrate a board connector 3 according to an embodiment of the invention. FIG. 4A is a front view of the board connector 3, FIG. 4B a side view and FIG. 4C a top view. FIGS. 4D and 4E show three-dimensional representations of the board connector 3.

The housing 12 of the board connector 3 provides the mating side 8 containing slots 11 filled with single ended contacts 10 as a mirror image of FIG. 2A. As such, the cable connector of FIGS. 3A-3C can be connected to this board connector 3.

The housing 12 of the board connector 3 is supported by pegs 30 for attachment of the board connector 3 to the PCB 5. The housing 12 is constructed such that a cut out in the PCB 5 is not required. As clearly shown in FIGS. 4B, 4D and 4E, the housing 12 only contains a portion 31 with guiding slots 32, arranged for cooperating with the guiding bars 24 at the exterior of the housing 12 of the cable connector 2, at the upper side of the housing 12. However, it should be appreciated that also the lower side of the housing 12 may be provided with a small guiding plate without requiring a cut-out in the PCB 12.

As is best illustrated in FIG. 4E, at the rear part of the housing 12, a diagonal section is cut away from the housing such that an increasingly larger portion of leads 33 that connect the single ended contacts 10 with the press fit terminals 6 is exposed towards the rear side of the housing 12. Consequently, straight leads 33 may be loaded in the housing from the rear side and even the shortest leads 33 can be bent after being introduced in the housing 12. It is noted that a compensation member (not shown) can be used to fill the diagonally cut away section after bending of the leads 33 in order to provide protection and stability for the leads 33. Intermediate walls 34 have been provided between the leads 33 in the cut-away section on the rear part of the housing in order to provide mechanical robustness and stability to the board connector so as to withstand insertion force exerted on said connector during its mounting onto the circuit board.

Figure 5:
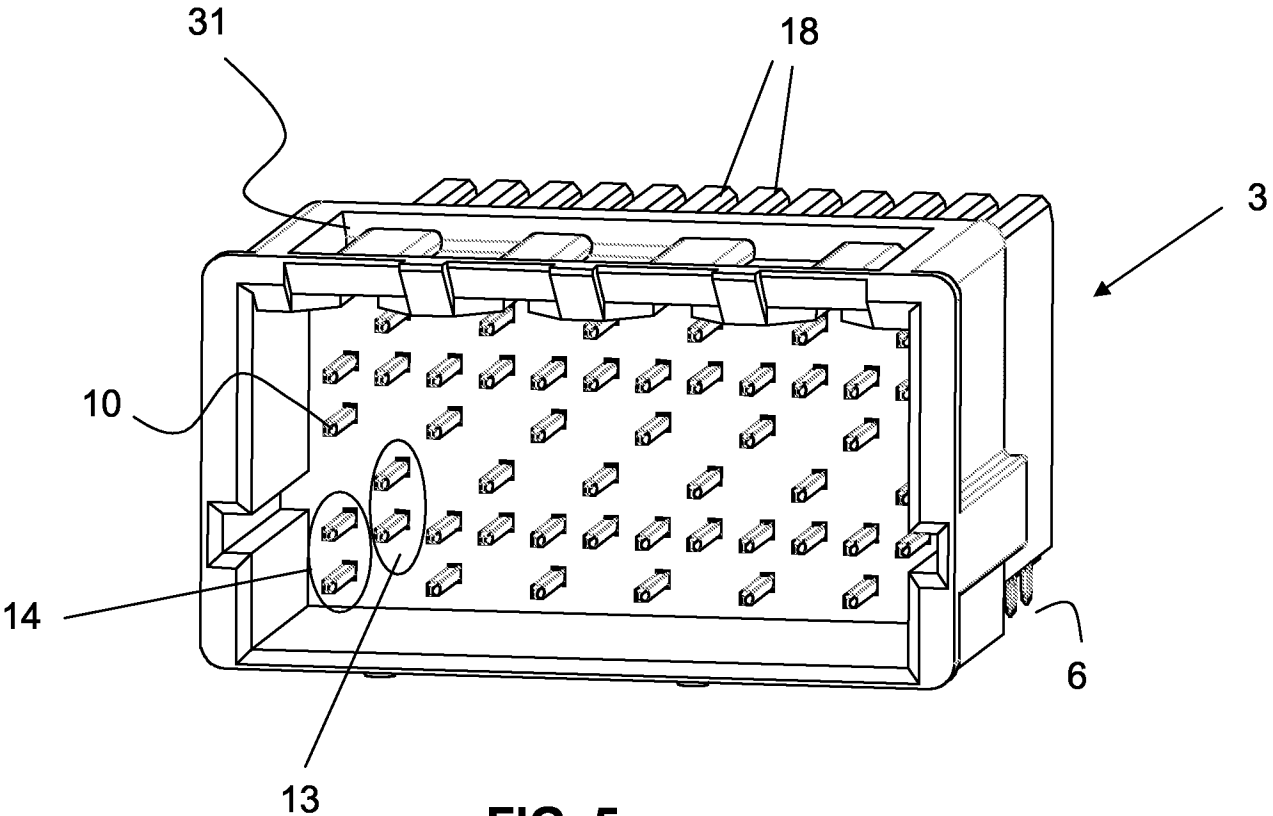
FIG. 5 illustrates a board connector according to a further embodiment of the invention.

As already briefly mentioned with reference to FIG. 1, the footprint as defined by the terminals 6 of the board connector 3 is enhanced. In particular, as indicated in FIG. 4B, the distance $d_1$ between the single ended contacts 10 at the mating side 8 is enhanced at the board side as indicated by the distance $d_2$ between the corresponding terminals 6. As a result, the single ended contacts 10 at the mating side 8 of the board connector 3 can be arranged at distances suitable to match the arrangement of single ended contacts 9 at the mating side 7 of the cable connector 2, whereas requirements set at the board side of the board connector 3 for the minimum clearance and creepage distance can be met while allowing routing of signal traces on the PCB 5 between the terminals 6. It is noted that the distance between the pegs 30 and the terminals 6 is also sufficient to allow routing of signal tracks on the PCB 5. The requirements for the clearance and creepage distance for VDSL applications amounts to 1.0 mm for the distance between contacts of a pair 13, 14 and 1.5 mm for the distance between contacts of adjacent pairs. The width of the signal tracks on the PCB may e.g. by 0.5 mm. Finally, FIG. 5 shows a board connector 3 in accordance with the arrangement of contacts 10 shown in FIG. 2D with reversed rows and columns. In this embodiment, modules (also referred to as IMLA's) provided with single ended contacts 10 are arranged in a housing 12 that comprises slots 11 only for the contacts 10 in order to form pairs 13, 14 of single ended contacts 10. In contrast with the embodiment of FIGS. 4A-4E, no empty slots 11 are provided.

The invention claimed is:

1. An electrical connector comprising:

an insulating connector housing containing a plurality of slots arranged in a matrix of rows and columns, and a plurality of single ended contacts arranged in said slots, wherein said single ended contacts are arranged in row wise pairs in said slots of said matrix, such that, in a first row, a first pair of said contacts accommodates slots in a first column and a second column of said matrix and, in a second row adjacent, to said first row, a second pair of said contacts accommodates slots in said second column and a third column of said matrix, wherein positions corresponding respectively to the first row and the third column, and to the first column and the second row are free of contact and wherein said electrical connector is a tip and ring connector and wherein each of said pairs of contacts has a tip contact and a ring contact, where the ring contact is configured to form a battery side and the tip contact is configured to form a ground side of an electrical circuit through the tip and ring contacts, where the battery side is configured to carry a voltage of about −48 Volts, and where the connector comprises no shielding contacts between adjacent pairs of the tip and ring contacts.

2. The electrical connector according to claim 1, wherein said matrix comprises contact-free slots in said rows of said matrix between said pairs of contacts.

3. The electrical connector according to claim 1, wherein said slots are substantially equidistant slots in a direction of said rows and columns.

4. The electrical connector according to claim 1, wherein said slots are free of signal ground contacts.

5. The electrical connector according to claim 1, wherein said electrical connector is a board electrical connector comprising a mating side with said single ended contacts arranged in said slots of said matrix capable of receiving a mating connector and wherein said board electrical connector further comprises a board side with board contacts, each of said board contacts being in electrical connection with a corresponding one of said single ended contacts, and wherein a distance between single ended contacts of said first and second pairs in a direction of said columns of said matrix is smaller than a distance between corresponding pairs of said board contacts.

6. The electrical connector according to claim 1, wherein said electrical connector is a board electrical connector comprising a board side with board contacts, each of said board contacts being in electrical contact with a corresponding one of said single ended contacts via electrical leads and wherein said insulating housing comprises intermediate walls separating groups of said electrical leads at a portion near said board contacts.

7. The electrical connector according to claim 1, wherein said electrical connector is a board connector and wherein said insulating housing accommodates a plurality of modules, each containing a single row or column of said single ended contact pairs.

8. The electrical connector according to claim 1, wherein said electrical connector is free of ground contacts.

9. An electrical connection system comprising a cable connector and a board connector, wherein at least one of said cable connector and said board connector comprises an electrical connector according to claim 1.

10. The electrical connector according to claim 1, where the tip contact and the ring contact are not differential signal contacts.

11. The electrical connector according to claim 1, where the ring contact is a single end contact configured to transmit signal frequencies of about 20-30 MHz.

12. The electrical connector according to claim 1, wherein said insulating connector housing accommodates a plurality of modules containing said slots for said single ended contacts and wherein said electrical connector is in use free of electromagnetic shielding plates between said modules.

13. The electrical connector according to claim 12, wherein said modules are identical modules and said single ended contacts are arranged identically in each of said modules.

14. An electrical connector comprising:

an insulating connector housing containing a plurality of contact receiving slots arranged in a matrix of rows and columns, and a plurality of single ended contacts arranged in the slots, wherein the single ended contacts are arranged in row wise pairs in the slots of the matrix, such that, in a first row, a first pair of the contacts are located in the slots of a first column and a second column of the matrix and, in a second row adjacent to the first row, a second pair of the contacts are located in the slots in the second column and a third column of the matrix, where positions corresponding, respectively, to the first row and the third column, and to the first column and the second row are free of contacts, and where the electrical connector is a tip and ring connector with each of the pairs of contacts being a tip contact and a ring voltage contact, where the ring voltage contact is configured to form a battery side and the tip contact is configured to form a ground side of an electrical circuit through the tip and ring contacts, where the ring voltage contact is a sin le end contact configured to transmit signal frequencies of about 20-30 MHz.

15. The electrical connector according to claim 14, where the slots in the matrix are free of contacts in the rows of the matrix between the pairs of contacts.

16. The electrical connector according to claim 14, where the slots are substantially equidistant slots in a direction of the rows and columns.

17. The electrical connector according to claim 14, where the tip contact and the ring voltage contact are not differential signal contacts.

18. The electrical connector according to claim 14, where the battery side is configured to carry a voltage of about −48 Volts.

19. The electrical connector according to claim 14, where the connector does not comprise shielding contacts between adjacent pairs of the tip and ring contacts.

20. The electrical connector according to claim 14, further comprising a plurality of modules containing the slots and the single ended contacts, where the modules are connected in the insulating connector housing, and where the electrical connector does not comprise electromagnetic shielding plates between the modules.

21. The electrical connector according to claim 20, wherein the modules are identical modules and the single ended contacts are arranged identically in each of the modules.

22. The electrical connector according to claim 20, wherein the modules are free of ground contacts.

* * * * *

UNITED STATES PATENT AND TRADEMARK OFFICE

CERTIFICATE OF CORRECTION

PATENT NO. : 8,550,852 B2
APPLICATION NO. : 12/451594
DATED : October 8, 2013
INVENTOR(S) : Thierry Goossens et al.

It is certified that error appears in the above-identified patent and that said Letters Patent is hereby corrected as shown below:

IN THE CLAIMS:

In Claim 14: Column 8, line 13, delete "sin le" and insert --single-- as it appears in the Amendment filed October 16, 2012.

Signed and Sealed this
Twenty-fourth Day of December, 2013

Margaret A. Focarino

Margaret A. Focarino
*Commissioner for Patents of the United States Patent and Trademark Office*